US008561694B2

(12) United States Patent
Hemblade

(10) Patent No.: US 8,561,694 B2
(45) Date of Patent: Oct. 22, 2013

(54) MONITORING DOWNHOLE PRODUCTION FLOW IN AN OIL OR GAS

(75) Inventor: Barry John Hemblade, Hove (GB)

(73) Assignee: Teledyne Limited, Middlesex (GB)

( * ) Notice: Subject to any disclaimer, the term of this patent is extended or adjusted under 35 U.S.C. 154(b) by 407 days.

(21) Appl. No.: 12/918,301

(22) PCT Filed: Feb. 18, 2009

(86) PCT No.: PCT/GB2009/000445

§ 371 (c)(1), (2), (4) Date: Aug. 18, 2010

(87) PCT Pub. No.: WO2009/103971

PCT Pub. Date: Aug. 27, 2009

(65) Prior Publication Data

US 2010/0326654 A1 Dec. 30, 2010

(30) Foreign Application Priority Data

Feb. 19, 2008 (GB) ..... 0803001.7

(51) Int. Cl.
*E21B 43/08* (2006.01)

(52) U.S. Cl.
USPC ..... 166/250.01; 166/66; 166/236; 166/243

(58) Field of Classification Search
USPC ..... 166/250.01, 250.05, 250.7, 242.4, 376, 166/66, 236, 243; 73/86; 210/85, 87, 96.1, 210/497.01
See application file for complete search history.

(56) References Cited

U.S. PATENT DOCUMENTS

| | | | | |
|---|---|---|---|---|
| 3,236,096 | A * | 2/1966 | Macatician et al. | 73/86 |
| 3,352,154 | A * | 11/1967 | Djorup | 73/170.12 |
| 3,782,181 | A * | 1/1974 | Gurtler | 73/86 |
| 3,939,709 | A * | 2/1976 | Echtler | 73/861.73 |
| 3,948,324 | A * | 4/1976 | Lybarger | 166/307 |
| 4,135,395 | A * | 1/1979 | Sullivan et al. | 73/861.21 |
| 4,674,337 | A * | 6/1987 | Jonas | 73/861.73 |
| 5,211,677 | A * | 5/1993 | Sargeant et al. | 73/61.71 |
| 5,740,861 | A * | 4/1998 | Williams | 166/66 |
| 6,114,857 | A | 9/2000 | Kohl | |
| 6,125,935 | A | 10/2000 | Shahin, Jr. | |

(Continued)

FOREIGN PATENT DOCUMENTS

| | | |
|---|---|---|
| GB | 2 286 844 A | 8/1995 |
| GB | 2 360 584 A | 9/2001 |

(Continued)

*Primary Examiner* — Nicole Coy
*Assistant Examiner* — Blake Michener
(74) *Attorney, Agent, or Firm* — Workman Nydegger

(57) ABSTRACT

An apparatus monitors a production flow from a gravel pack into a tubular sand screen disposed concentrically around downhole production tubing in an oil or gas well. A tubular sample layer is disposed concentrically around the sand screen to be exposed to the radial production flow in use. The sample layer is electrically insulated from the production tubing in use. An erosion sensor provides a signal which varies in dependence upon an electrical resistance of the sample layer, which is related to the erosion of the sample layer. An apparatus also monitors a substantially longitudinal production flow through downhole production tubing in an oil or gas well. A method and apparatus are used to monitor the condition of a gravel pack within an oil or gas well. Other methods monitor temperature or pressure conditions within an oil or gas well.

21 Claims, 4 Drawing Sheets

(56) References Cited

U.S. PATENT DOCUMENTS

| | | | | |
|---|---|---|---|---|
| 6,946,855 | B1 * | 9/2005 | Hemblade | 324/700 |
| 7,594,434 | B2 * | 9/2009 | Dagenais et al. | 73/152.54 |
| 7,878,047 | B2 * | 2/2011 | Hemblade | 73/61.75 |
| 2002/0121371 | A1 * | 9/2002 | Moake et al. | 166/250.07 |
| 2002/0125008 | A1 * | 9/2002 | Wetzel et al. | 166/278 |
| 2003/0029232 | A1 * | 2/2003 | Felix et al. | 73/86 |
| 2004/0173352 | A1 | 9/2004 | Mullen et al. | |
| 2005/0074196 | A1 | 4/2005 | Grigsby et al. | |
| 2005/0248334 | A1 | 11/2005 | Dagenais et al. | |
| 2005/0274513 | A1 | 12/2005 | Schultz et al. | |
| 2007/0012453 | A1 | 1/2007 | Coronado et al. | |
| 2007/0125535 | A1 | 6/2007 | Coronado | |
| 2008/0028838 | A1 * | 2/2008 | Andersen et al. | 73/61.73 |
| 2008/0282781 | A1 * | 11/2008 | Hemblade | 73/61.75 |

FOREIGN PATENT DOCUMENTS

| | | | |
|---|---|---|---|
| GB | 2 386 625 | A | 9/2003 |
| GB | 2 399 637 | A | 9/2004 |
| GB | 2 431 993 | A | 5/2007 |
| GB | 2 436 579 | A | 10/2007 |

* cited by examiner

MONITORING DOWNHOLE PRODUCTION FLOW IN AN OIL OR GAS

FIELD OF THE INVENTION

The present invention relates to methods and apparatuses for monitoring downhole production flow in an oil or gas well. The well is generally of the type having production tubing, a sand screen disposed concentrically around the production tubing, an outer casing, and a gravel pack disposed annularly between the sand screen and the outer casing. The methods and apparatuses described herein relate to monitoring downhole production flow within the production tubing and/or through the sand screen.

BACKGROUND OF THE INVENTION

Hydrocarbon fluids such as oil and natural gas are obtained from a subterranean geological formation, referred to as a reservoir, by drilling a well that penetrates the hydrocarbon-bearing formation. Once a wellbore has been drilled, the well must be "completed". Completion is the process in which the well is enabled to produce hydrocarbons. A completion involves the design, selection and installation of equipment and materials in or around the wellbore for conveying, pumping, or controlling the production or injection of fluids. After the well has been completed, production of oil and gas can begin.

A schematic representation of such a well 10 passing through a reservoir is shown in FIG. 1. The wellbore is typically separated from the reservoir by a perforated casing 16. Production tubing 12 is disposed concentrically within the casing 16. The production flow passes from the reservoir substantially radially into the wellbore (see arrows X), and eventually passes substantially longitudinally up the production tubing (see arrows Y).

Sand or silt flowing into a wellbore from unconsolidated formations (again, see arrows X in FIG. 1) can accumulate within the wellbore, leading to reduced production rates and damage to subsurface production equipment. Migrating sand has the possibility of packing off around the subsurface production equipment, or may enter the production tubing 12 and become carried into the production equipment. Due to its highly abrasive nature, sand contained within the production streams can result in the erosion of tubing, flowlines, valves and processing equipment. In addition to erosion, excessive sand entrained in a fluid may cause blockage of the fluid flow through the production tubing. Therefore, it is also important to measure the amount of sand entrained in a given production flow and correlate this quantity to erosion. The problems caused by sand production can significantly increase operational and maintenance expenses and can lead to a total loss of the well 10.

One means of controlling sand production is the placement of gravel (i.e. relatively large grain sand) around the exterior of a slotted, perforated, or other type liner or sand screen 14 having an outside layer usually referred to as a shroud. Amongst other things, the gravel serves as a filter to help ensure that, sand does not migrate with the produced fluids into the wellbore. In a typical gravel pack completion, the sand screen 14 is placed in the wellbore and positioned within the unconsolidated formation that is to be completed for production. The sand screen 14 is typically connected to a tool that includes a production packer and a cross-over, and the tool is in turn connected to a work or production tubing string. The gravel is mixed with a carrier fluid and pumped in slurry form down the tubing and through the cross-over, thereby flowing into the annulus between the sand screen 14 and wellbore casing 16. The carrier fluid in the slurry leaks off into the formation and/or through the sand screen 14. The sand screen 14 is designed to prevent the gravel in the slurry from flowing through it and entering into the production tubing 12. As a result, the gravel is deposited in the annulus around the sand screen 14 where it forms a gravel pack 18.

It is important to size the gravel for proper containment of the formation sand, and the sand screen 14 must be designed in a manner to prevent the flow of the gravel through the sand screen 14. However, the size of the gravel (and hence the mesh size of the screens) should not be so small as to inhibit production rates due to lower permeability. Thus gravel packs 18 and sand screens 14 can potentially permit the flow of very small particles (i.e. "fines") through into the production tubing 12.

If fines are produced, a potential exists to cause erosion damage to the sand screen 14 and production tubing 12. The erosion damage to the sand screen 14 will depend on the erosion resistance of the sand screen 14 and the erosive properties of the produced fines under the prevailing flow conditions. If the fines begin to damage the sand screen 14 then the effectiveness of the sand screen 14 to inhibit the flow of larger sand particles is progressively diminished. As a result, potentially larger sand particles can pass through the sand screen 14. The larger mass of these particles will possess a greater capacity to cause accelerated erosion. The erosion properties of particles are strongly influenced by particle kinetic energy. The higher the particle mass and velocity, the higher is the erosion potential.

The radial flow velocity increases as the flow progresses from the formation, through the gravel pack 18 and into the sand screen 14. The radial velocity at the outlet of the sand screen 14 is at its highest and could represent the highest risk of erosion from particles flowing through the sand screen 14.

Due to the potentially complex flow regime from the reservoir into the gravel pack 18 and through the sand screen 14, as well as the potential for localised blockages, often known as "plugging", and the potential for non-uniform sand screen material erosion resistance, the probability of a uniform erosion rate distribution throughout the sand screen 14 is unlikely. As localised erosion develops within the sand screen 14, the tendency of the flow will always be to follow the path of least resistance. This will therefore potentially further accelerate the localised erosion.

As erosion progresses, the sand screen 14 could eventually experience erosion damage of the mesh to the extent of reaching the size of the gravel. Under these conditions movement and localised flow of the gravel pack 18 could occur. This process can create gravel pack voids commencing destabilisation of the gravel pack 18 itself. This destabilisation process is often known as "fluidisation" of the gravel pack 18.

As the gravel pack 18 destabilises and fluidises, aggressive erosion conditions are created at the screen/gravel-pack interface. This highly turbulent flow regime will potentially cause further accelerated erosion of the external surface of the sand screen 14. The sand screen 14 and well 10 are now moving into the advanced stages of catastrophic failure.

Sand screens 14 and production tubing 12 are manufactured from a number of metallurgies and fabrication processes and are configured according to the specific application. Sand screens 14 and production tubing 12 are designed to optimise particle flow to minimise erosion. Each configuration will accordingly possess different levels of erosion risk dependant upon application.

The present invention seeks to provide methods and apparatuses for monitoring downhole production flow characteristics in an oil or gas well. In addition to monitoring flow conditions, it is intended that the methods and apparatuses can also provide indications of the condition of both the sand screen and the gravel pack so as to provide early warnings of potential catastrophic failure.

SUMMARY OF THE INVENTION

According, to a first aspect of the present invention, there is provided an apparatus for monitoring a production flow from a gravel pack into a tubular sand screen disposed concentrically around downhole production tubing in an oil or gas well. The apparatus comprises a tubular sample layer arranged to be disposed concentrically around the sand screen so as to be exposed to the radial production flow in use. The sample layer is electrically insulated from the production tubing in use. The apparatus further comprises an erosion sensor arranged to provide a signal which varies in dependence upon an electrical, resistance of the sample layer. The electrical resistance of the sample layer is related to the erosion of the sample layer.

The claimed apparatus thus provides a compact arrangement for sensing erosion of the sample layer, whilst at the same time providing structural integrity to the well. Advantageously, the sample layer may be integrally formed with the sand screen or may be formed as a shroud for the sand screen, thus providing further economy of space in the confined downhole environment. Further flow sensors (e.g. for measuring temperature, pressure and acoustics) may be included in the apparatus to provide additional information concerning the production flow from the gravel pack into the sand screen. Thus anomalous well conditions may be detected early to enable well operators to take action if necessary.

According to a second aspect of the present invention, there is provided an apparatus for monitoring a substantially longitudinal production flow through downhole production tubing in an oil or gas well. The apparatus comprises a body portion, and mounting portions connected to the body portion and adapted to mount the body portion within the production tubing. The body portion comprises an erosion sensor having an erosion sensor sample surface arranged to be exposed to the production flow in use, the erosion sensor being arranged to provide, an erosion sensor signal which varies in dependence upon an electrical resistance of the erosion sensor sample surface. The body portion comprises a sample acoustic sensor arranged to be exposed to the production flow in use, the sample acoustic sensor being acoustically decoupled from the production tubing in use and being arranged to provide a sample acoustic sensor signal which varies in dependence upon acoustic noise generated by impacts of particles and fluid in the production flow, on the sample acoustic sensor.

Such an apparatus provides a compact arrangement for monitoring the production flow within the production tubing itself. Further flow sensors (e.g. for measuring temperature, pressure, corrosion and acoustics) may be included in the apparatus to provide additional information concerning the production flow within the production tubing. The body portion and the associated sensors (e.g. erosion and acoustic sensors) are located entirely within the production tubing in use. Thus, this apparatus provides measurements of the production flow itself.

In a preferred embodiment, the body portion comprises a substantially conical section having a cross-sectional area which increases in the direction of the production flow in use.

According to a third aspect of the present invention, there is provided a method of monitoring the production flow in a plurality of producing zones in an oil or gas well. The method comprises (a) providing an apparatus according to the second aspect of the present invention for each respective producing zone; (b) mounting each said apparatus in production tubing in the vicinity of a respective producing zone using, the mounting portions; and (c) monitoring the production flow in each producing zone using a respective said apparatus.

According to a fourth aspect of the present invention, there is provided a method of monitoring the condition of a gravel pack disposed within an oil or gas well. The well is of the type that comprises production tubing, a sand screen disposed concentrically around the production tubing, and an outer casing. The gravel pack is disposed annularly between the sand screen and the outer casing. The method comprises (a) disposing a tubular sample layer concentrically between the sand screen and the gravel pack; (b) measuring erosion of the tubular, sample layer, the tubular sample layer being erodable by the production flow and by the gravel pack; (c) disposing a sample surface within the production tubing; (d) measuring erosion of the sample surface, the sample surface being erodable by the production flow; (e) comparing the measured erosion of the tubular sample layer and the measured erosion of the sample surface so as to deduce an extent of erosion of the tubular sample layer by the gravel pack; and (f) thereby deducing a condition of the gravel pack.

In one embodiment, the deducing step comprises deducing whether the gravel pack has fluidised. Such information can provide an early warning of potential failure of the sand screen.

An apparatus for monitoring the condition of a gravel pack disposed within an oil or gas production well is also provided. Again, The well is of the type that comprises production tubing, a sand screen disposed concentrically around the production tubing, and an outer casing. The gravel pack is disposed annularly between the sand screen and the outer casing. The apparatus comprises a tubular sample layer arranged to be disposed concentrically between the sand screen and the gravel pack, and a first erosion sensor for measuring erosion of the tubular sample layer, the tubular sample layer being erodable by the production flow and by the gravel pack in use. The apparatus further comprises a sample surface arranged to be disposed within the production tubing, and a second erosion sensor for measuring erosion of the sample surface, the sample surface being erodable by the production flow in use. In addition, the apparatus includes a processor for comparing the measured erosion of the tubular sample layer and the measured erosion of the sample surface.

According to a fifth aspect of the present invention, there is provided a method of monitoring temperature conditions within an oil or gas well, the well comprising production tubing, a sand screen disposed concentrically around the production tubing, an outer casing, and a gravel pack disposed annularly between the sand screen and the outer casing. The method comprises (a) measuring a temperature of the production flow through the gravel pack; (b) measuring a temperature of the production flow through the production tubing; and (c) comparing the measured temperatures so as to calculate a temperature difference between the production flow through the gravel pack and the production flow through the production tubing.

Advantageously, the method further comprises deducing a condition of the sand screen from the calculated temperature difference.

According to a sixth aspect of the present invention, there is provided a method of monitoring pressure conditions within an oil or gas well, the well comprising production tubing, a sand screen disposed concentrically around the production tubing, an outer casing, and a gravel pack disposed annularly between the sand screen and the outer casing. The method comprises (a) measuring a pressure of the production flow through the gravel pack; (b) measuring a pressure of the production flow through the production tubing; and (c) comparing the measured pressure so as to calculate a pressure difference between the production flow through the gravel pack and the production flow through the production tubing.

Advantageously, the method further comprises deducing a condition of the sand screen from the calculated pressure difference.

Other preferred features of the present invention are set out in the appended claims.

BRIEF DESCRIPTION OF THE DRAWINGS

Embodiments of the present invention will now be described by way of example with reference to the accompanying drawings in which.

DETAILED DESCRIPTION OF A PREFERRED EMBODIMENT

Figure 1:
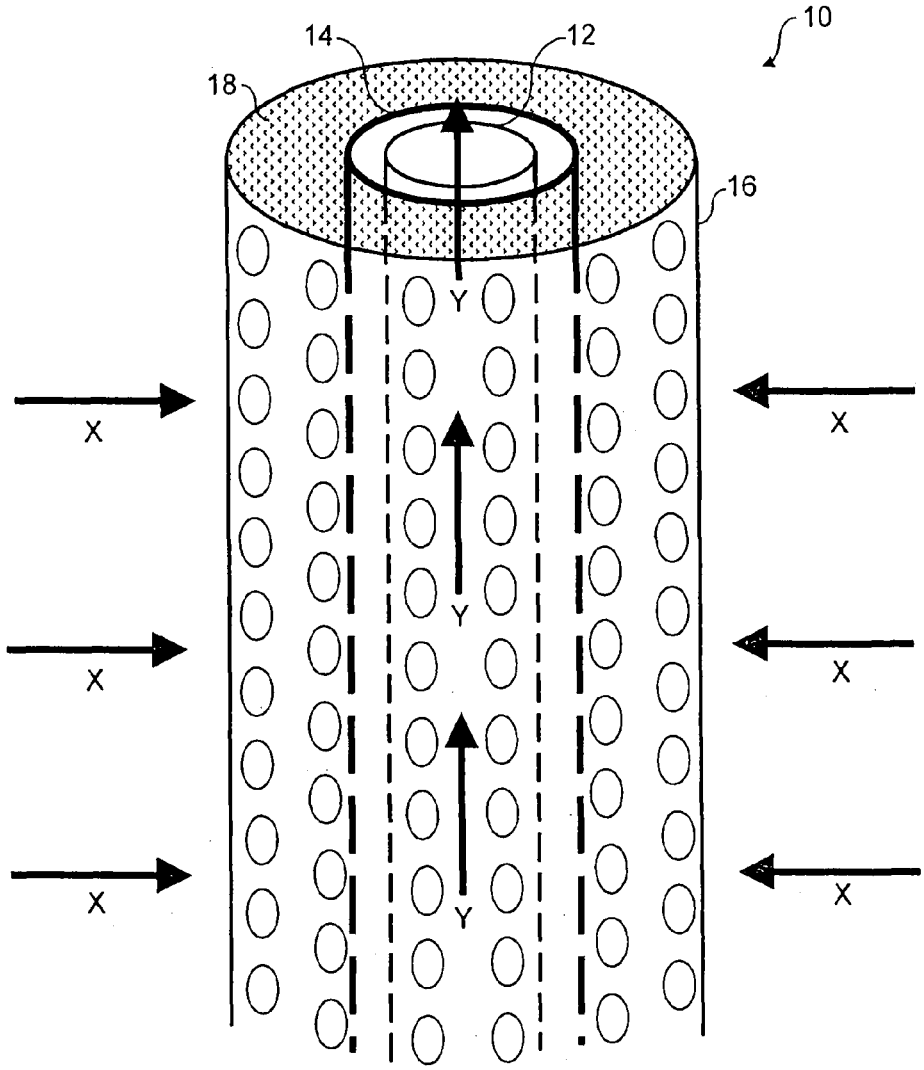
FIG. 1 PRIOR ART
FIG. 1 is a schematic representation of a prior art oil or gas well showing the downhole production tubing, sand screen, gravel pack and outer casing.

As discussed above, the present invention relates to methods and apparatuses for monitoring a downhole production flow in an oil or gas well. The well is generally of the type described above with reference to the prior art. In particular, the well 10 has production tubing 12, a sand screen 14 disposed concentrically around the production tubing 12, an outer casing 16, and a gravel pack 18 disposed annularly between the sand screen 14 and the outer casing 16. The methods and apparatuses described relate to monitoring downhole production flow within the production tubing 12 and/or through the sand screen 14. In addition this monitoring information is used to understand the stability of the gravel pack and/or the condition of the sand screen 14.

Figure 2:
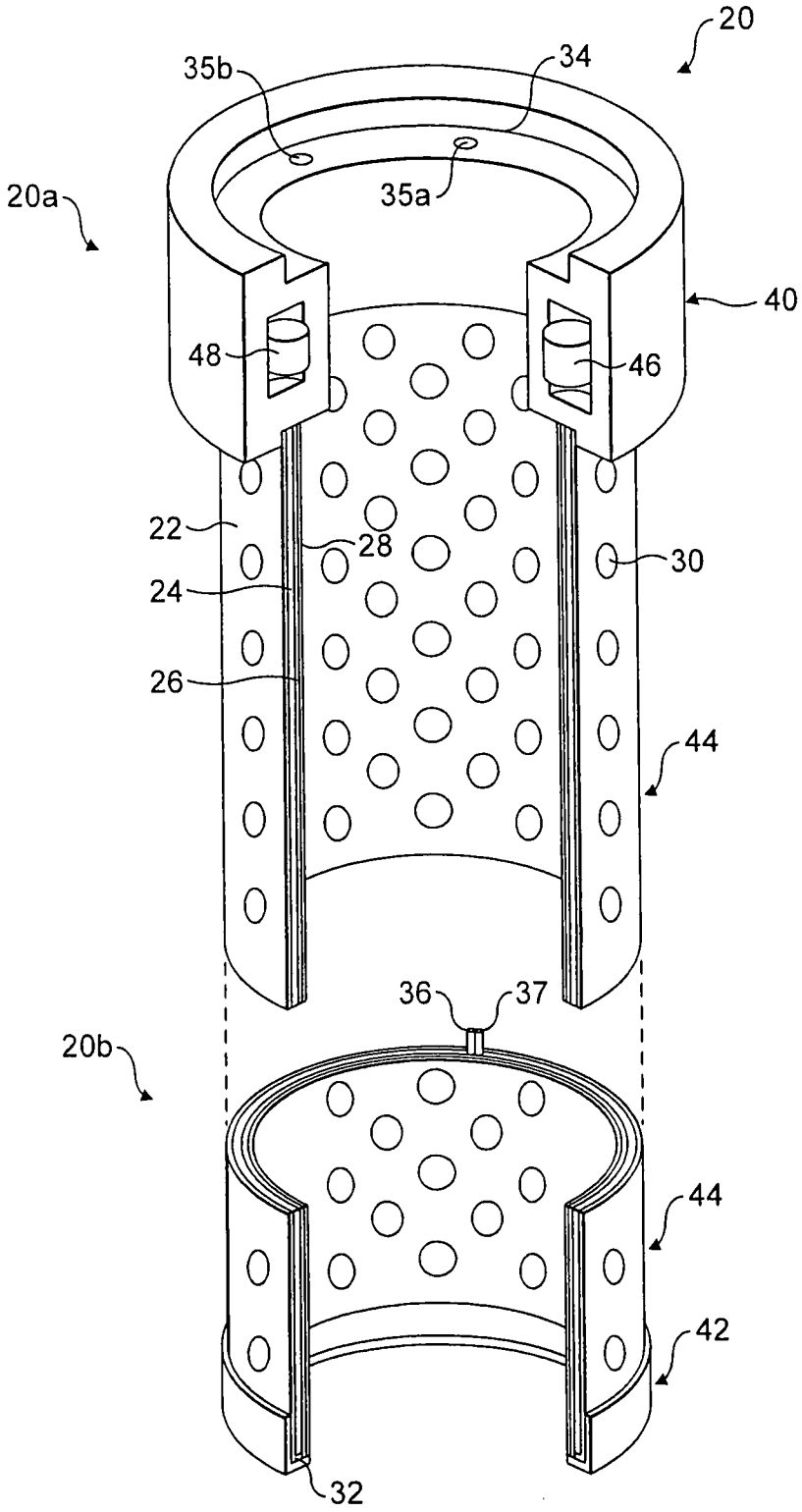
FIG. 2 is a perspective view of an apparatus for monitoring production flow from the gravel pack into the sand screen.

Let us first consider a substantially cylindrical apparatus 20, as shown in FIG. 2, for monitoring a production flow from the gravel pack 18 into the sand screen 14.

A typical sand screen 14 is many-layered and includes a wire mesh or a wire wrap to prevent the flow of sand. The wire mesh or wire wrap is surrounded by an outer shroud to provide structural integrity. In one embodiment, the apparatus 20 is integrally formed with the sand screen 14. Alternatively, the apparatus 20 is formed as a shroud for the sand screen 14, or is arranged to be disposed concentrically around a shroud of the sand screen 14. Thus, the cylindrical or tubular shape of the apparatus 20 is related to the tubular shape of the associated production tubing 12 and sand screen 14. Thus, alternative shapes of the apparatus 20 are envisaged if different shapes of sand screen 14 and production tubing 12 are used.

The apparatus 20 includes top and bottom end portions 20*a* and 20*b* as shown in FIG. 2. The top end portion 20*a* includes a top collar 40 substantially formed as a ring. The bottom end portion 20*b* includes a bottom collar 42 substantially formed as a ring. Extending between the top and bottom collars 40 and 42 is a tubular portion 44. In FIG. 2, the tubular portion 44 is shown in two separate pieces, but this is purely for the purposes of illustration and it will be appreciated that the tubular portion 44 in fact extends continuously from the top collar 40 to the bottom collar 42.

The apparatus 20 is sized to fit conveniently around the sand screen 14 and production tubing 12. For typical production tubing 10 having a diameter of approximately 100 mm within an outer casing having a diameter of about 250 mm, the diameter of the tubular portion will be around 105 mm. In one embodiment, the length of the tubular portion is about 9 m. These dimensional values are, given for the purposes of illustration only and are not intended to limit the scope of the invention.

Figure 3:
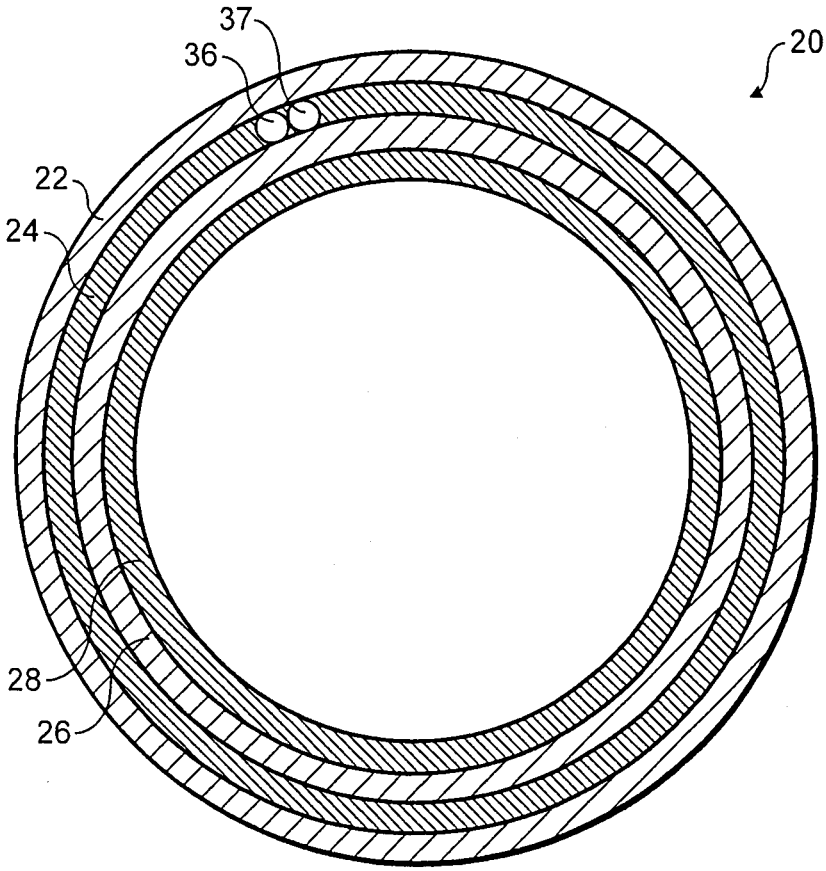
FIG. 3 is a cross-sectional view through the apparatus of FIG. 2.

FIG. 3 is a cross-section through the tubular portion 44 of the apparatus 20 showing that the tubular portion 44 comprises four layers. The external layer is an electrically-conducting tubular sample layer 22 which is exposed to the radial production flow X in use. The sample layer 22 is electrically insulated from the production tubing 12 in use. Disposed concentrically within the sample layer is a first electrically-insulating tubular layer 24. Then, concentrically within the first insulating layer 24, there is an electrically-conducting tubular reference layer 26. The reference layer 26 is similar to the sample layer 22 in material construction, but the reference layer 26 is protected from exposure to the radial production flow X in use. Finally, there is a second electrically-insulating tubular layer 28 disposed concentrically within the reference layer 26. As shown in FIG. 2, there are perforations 30 formed in all four layers of the tubular portion 44 to allow for the radial production flow X through the apparatus 20 in use.

The apparatus 20 includes two longitudinal spines 36 and 37. One spine 36 contains wiring and cables to provide power and communications to the apparatus 20. In particular, the power and communications spine 36 is used to convey downhole sensor measurements to the surface (the downhole sensors of the apparatus 20 will be described in more detail below). The other spine 37 provides pairs of electrical connection points at longitudinal intervals along the tubular portion 44. The function of the electrical connection points is discussed further below.

In FIGS. 2 and 3, the spines 36 and 37 are both disposed within the first insulating layer 24. Alternative arrangements are also envisaged. For example, one or both of the spines 36 and 37 may be disposed in the outer casing 16. However, it is advantageous to provide the electrical connection point spine 37 within the first insulating layer 24 so as to provide easy access to both the sample layer 22 and the reference layer 26. It will be understood that it is not essential to provide the spines 36 and 37 directly adjacent to one another, as shown in FIGS. 2 and 3. In an alternative embodiment, the spines 36 and 37 may be circumferentially displaced from one another.

The sample layer 22 and the reference layer 26 are connected in series by means of an electrical connector 32 adjacent to the bottom collar 42 in the bottom end portion 20*b* of the apparatus 20.

In this embodiment, the sample layer 22 and the reference layer 26 together form part of an erosion sensor for detecting erosion in the region of the sand screen 14. The erosion sensor is arranged to detect changes in electrical resistance of the sample layer 22 and also to detect changes in the electrical resistance of the reference layer 26. Changes in electrical resistance of the sample layer 22 result mainly from loss of material from the sample layer 22 due to erosion, although material loss due to corrosion and/or erosion/corrosion processes may also occur—it should be noted that the term "erosion" is therefore used to refer not only to metal loss through erosion processes, but also to metal loss via corrosion and/or erosion/corrosion processes depending on the circumstances and the materials used to form the sample and reference layers. Temperature changes may also affect the electrical resistance of the sample layer 22.

The reference layer 26 is protected from exposure to the production flow, so that the electrical resistance of the reference layer 26 is independent of erosion effects. A comparison of the electrical resistances of the sample and reference layers 22 and 26 therefore enables compensation for any temperature effects (since the sample and reference layers 22 and 26 are subject to substantially the same temperature) so that the erosion of, the sample layer 22 may be inferred.

In order to infer the erosion of the sample layer 22, the erosion sensor is arranged to provide a compensated electrical resistance signal which varies in dependence upon a ratio of the electrical resistance of the sample layer 22 to the electrical resistance of the reference layer 26. The electrical resistances of the sample and reference layers 22 and 26 are measured by considering the two layers as resistors connected in series by the electrical connector 32 and by measuring the voltages across each "resistor".

As discussed in the background section, the sand screen 14 may fail due to erosion by fines, formation sand and/or destabilisation/fluidisation of the gravel pack. Therefore, the provision of an erosion sensor in the region of the sand screen provides an early warning of the onset of sand screen erosion, and thereby permits timely intervention so as to mitigate the sand production and related subsurface equipment damage and downstream flow assurance and integrity problems.

As mentioned above, the tubular portion 44 of, the apparatus would typically be about 9 m long. Therefore, in order to provide more localised information regarding erosion, the sample layer 22 and the reference layer 26 each comprise a number of pairs of electrical connection points (not shown) along the length of the tubular portion 44. Each pair of electrical connection points stems from the electrical connection point spine 37 as discussed above. In each pair, one electrical connection point connects to the sample layer 22 and the other electrical connection point connects to the reference layer 26. In a preferred embodiment, such pairs of electrical connection points are provided at 300 mm intervals along the length of tubular portion 44. An electrical current is driven down through the sample layer 22 and back up through the reference layer 26, and voltage values are picked off from the various electrical connection points so as to calculate electrical resistances of corresponding portions of the sample and reference layers 22 and 26. Thus the erosion effects on smaller portions of the apparatus may be inferred. In this way, even localised erosion may be detected.

It should be noted that a single well 10 may pass through multiple oil or gas producing zones between layers of impermeable rock. A single producing zone typically has a dimension of 10-100 m, so the apparatus 20 having the dimensions mentioned above is able to monitor erosion at sub-zone intervals. Therefore, it is possible to compare erosion measurements from each of the zones in a multiple-zone well 10. Such a multiple-zone well 10 may have intelligent completions that employ interval control valves to limit the flow from each zone. So, if the measured erosion from one zone is particularly high, it would be possible to control and limit the flow from that zone so as to potentially limit the quantity of sand produced and the resulting overall erosion.

Referring back to FIG. 2, the top collar 40 comprises a temperature sensor (not shown). The temperature sensor may comprise a thermocouple. However, in a preferred embodiment, the temperature sensor includes a temperature-independent calibrated resistor connected in series with the sample and reference layers 22 and 26. In this embodiment, the temperature sensor further comprises a means for measuring the voltage across the calibrated resistor. As mentioned above, the electrical resistance of the reference layer 26 varies with temperature. Therefore, by comparing a voltage across the reference layer 26 with a voltage across the calibrated resistor, it is possible to infer the temperature experienced by the apparatus 20 and to correct for temperature effects. Thus, in this embodiment, the temperature independent calibrated resistor is used for temperature compensation purposes as well as being a temperature sensor.

The top collar 40 is arranged to house various components and instrumentation for the apparatus 20, including circuitry and electronic components, such as the temperature-independent calibrated resistor mentioned above. In addition, the top collar 40 houses the circuitry which enables the calculation of the various voltages picked off from the various pairs of electrical connection points described above. Other circuitry (e.g. circuitry relating to the apparatus 60 of FIG. 4) may also be housed in the top collar 40. In one embodiment, the electronic components are provided on a flexible circuit board formed substantially as a ring within the top collar 40. The electronic components must be suitable to withstand the sorts of temperatures experienced downhole in production wells. Downhole temperatures can be in excess of 120° C., so high temperature resistant components are selected accordingly.

The top collar 40 also includes an acoustic sensor shown schematically at 46. The acoustic sensor 46 is acoustically coupled to an external sensor surface of the apparatus 20. The acoustic sensor 46 and its associated sensor surface are each acoustically decoupled from the production tubing 12. The acoustic sensor 46 is therefore arranged to provide a signal which varies in dependence upon acoustic noise generated by impacts of particles and fluid in the gravel pack 18 on the sensor surface. The sensor surface in this respect could be an external surface of the top collar 40 and/or an external surface of the tubular portion 44 of the apparatus 20. The acoustic sensor 46 is used to monitor the amount of particulate matter, such as sand, entrained in the production flow X.

The inclusion of a reference acoustic sensor is also envisaged within the scope of the present invention. In this embodiment (not shown), the reference acoustic sensor is acoustically decoupled from both the sensor surface of the apparatus 20 and the production tubing 12, and the reference acoustic sensor is arranged to provide a signal which varies in dependence upon acoustic noise detected by the reference acoustic sensor. The acoustic sensor 46 and the reference acoustic sensor are thus identically mounted except that the reference acoustic sensor is acoustically decoupled from the sensor surface whereas the acoustic sensor 46 is acoustically coupled to the sensor surface. Thus, the reference acoustic sensor experiences near identical process temperature and pressure effects which may then be used to compensate for any process induced offset and transient errors of the acoustic sensor 46. Hence, a temperature and pressure compensated acoustic signal may be derived based on the acoustic noise sensed by the two acoustic sensors, and this compensated acoustic signal is related only to the acoustic noise generated by the production flow and entrained particles impinging on the sensor surface of the apparatus 20.

The top collar 40 additionally comprises a pressure sensor shown schematically at 48 arranged to measure a pressure of the radial production flow X in the region of the gravel pack 18. The pressure sensor 48 is located on an external surface of the top collar 40. Therefore, the pressure sensor 48 measures a pressure of the radial production flow X in the gravel pack 18. Preferably, the pressure sensor 48 comprises an absolute pressure transducer.

It may be required to monitor the production flow X from the gravel pack 18 into the sand screen 14 along a portion of the wellbore that is longer than the length of the tubular section 44 of the apparatus 20. It is therefore intended that a plurality of apparatuses 20 may be stacked longitudinally on top of one another for this purpose. Thus, the top collar 40 comprises an annular recess 34 which is sized to receive the bottom collar 42, of another such apparatus 20 when it is stacked on top. Alternative methods of stacking are also envisaged, such as the bottom collar 42 of one apparatus 20 being connectable to the top collar 40 of another apparatus 20 by means of complementary screw threads or the like. The spines 36 and 37 may be arranged to extend the entire length of the stack when multiple apparatuses 20 are stacked as one unit. In particular, the spines 36 and 37 of one apparatus 20 may be, arranged to be connected to the corresponding spines of an adjacent apparatus. The connection of adjacent power and communication spines 36 enables the provision of a continuous electrical and power connection between the two apparatuses 20. For this purpose, a hole 35*a* is provided in the annular recess 34 of the top collar 40 to enable the spines 36 and 37 to connect to an adjacent apparatus 20. A further hole 35*b* is also shown in FIG. 2. This hole 35*b* is a locating hole arranged to receive a corresponding projection (not shown), protruding from the bottom collar 42 of an adjacent apparatus. This arrangement ensures that two adjacent apparatuses 20 are correctly oriented with respect to one another in use.

Figure 4:
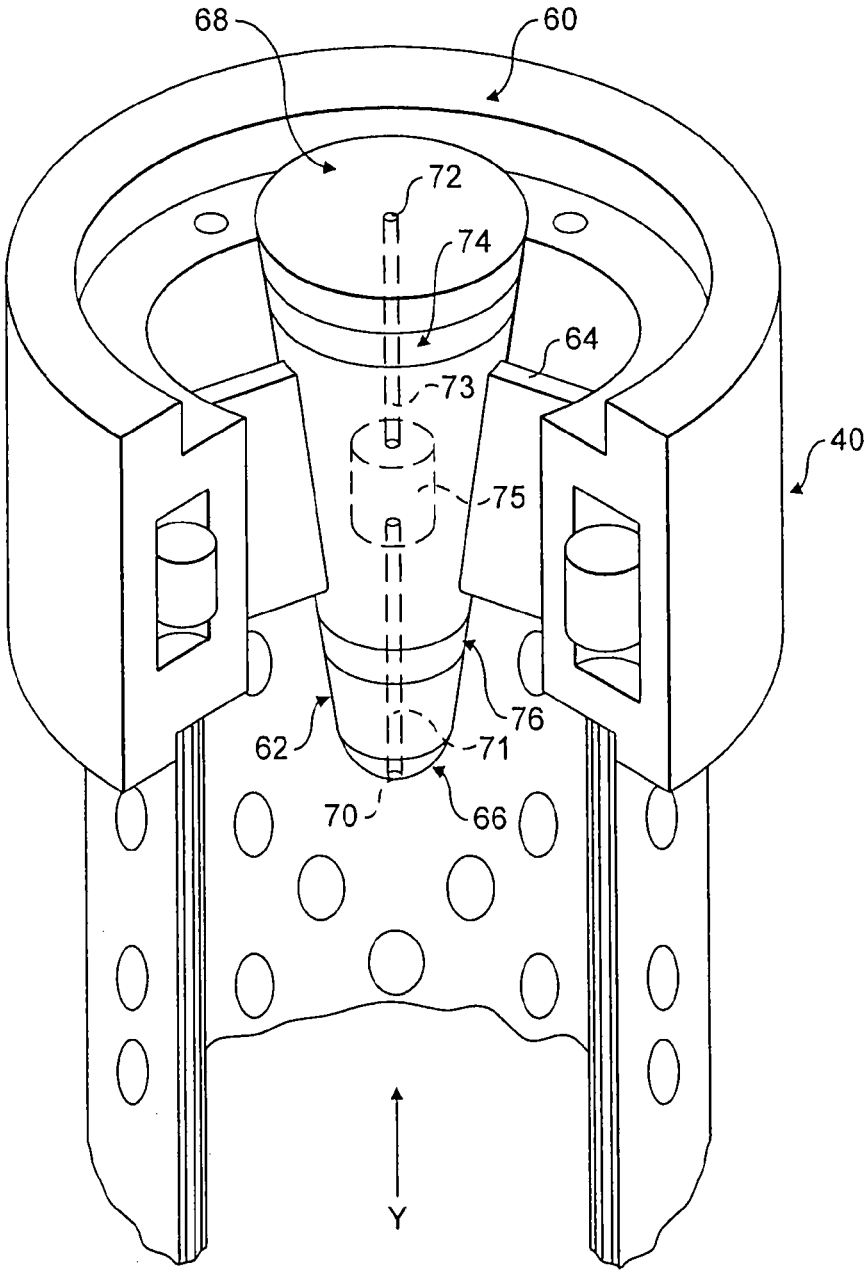
FIG. 4 is a perspective view of an apparatus for monitoring a production flow through the downhole production tubing.

Let us now consider an apparatus 60, as shown in FIG. 4, for monitoring the substantially longitudinal production flow Y within the downhole production tubing 12.

The apparatus 60 comprises an elongate body portion 62 mounted longitudinally within the production tubing 12 by means of three mounting fins 64.

The elongate body portion 62 is substantially conical with a cross-sectional area that increases from a first domed end 66 to a second planar end 68 of the body portion 62. Alternatively, the body portion 62 could be substantially cylindrical. However, it is preferred that the body portion 62 has an increasing cross-sectional area in the direction of the longitudinal production flow such that the flow is accelerated as it moves past the apparatus 60. The dimensions of the apparatus 60 are determined by the minimum dimensions of the various components (such as the differential pressure transducer 75 as described below). However, the apparatus 60 should not be so big as to block the flow Y through the production tubing 12 to a large degree. For mounting in typical production tubing having a diameter of about 100 mm, suitable dimensions for the body, portion would be a length of about 175 mm and a diameter of around 50 mm. However, these dimensions are given only by way of example and are not intended to limit the scope of the invention.

The three mounting fins 64 are mutually spaced from one another at 120 degree intervals around the circumference of the conical body portion 62. Each fin 64 is connected to and extends radially outwards from the conical body portion 62 as shown in FIG. 4. The three fins 64 have the same radial length such that the body portion 62 is mounted centrally within the production tubing 12. The fins 64 may each be shaped so as to disturb the production flow Y through the production tubing 12 as little as possible. One or more of the fins 64 may be partially hollow so as to convey electrical wires from the apparatus 60 to a location external to the production tubing 12.

In use, the mounting orientation of the apparatus 60 within the production tubing 12 is such that a longitudinal axis of the body portion 62 is parallel to a longitudinal axis of the production tubing 12. Furthermore, the domed end 66 of the body portion 62 is disposed upstream of the planar end 68 within the production flow Y. Thus, the domed end 66 faces the oncoming production flow Y in use.

At the central tip 70 of the domed end 66, there is a small aperture having a diameter of around 3 mm. This aperture extends'longitudinally into the body portion towards the forward (upstream) side of a differential pressure transducer 75. Thus, a first fluid path 71 is formed between the central tip 70 of the domed end 66 and the internal differential pressure transducer 75. Similarly, in the centre 72 of the planar end 68 of the body portion 62, there is another 3 mm aperture. This second aperture extends longitudinally into the body portion 62 towards the rearward (downstream) side of the differential pressure transducer 71. Thus, a second fluid path 71 is formed between the centre 72 of the planar end 68 and the internal differential pressure transducer 75. Circuitry (not shown) associated with the differential pressure transducer 75 may be provided within the top collar 40 and coupled to the differential pressure transducer 75 via wires extending through one or more of the mounting fins 64.

In this way, the differential pressure transducer 75 can be used to sense a pressure difference between the fluid flow at the domed end 66 and the fluid flow at the planar end 68. Bernoulli's equation means that there is a pressure drop between the domed end 66 and the planar end 68 due to the accelerated flow. The pressure drop is a function of flow speed, so it is possible to infer the production flow from the calculated pressure drop. In use, changes in pressure drop are therefore important as they imply a change in flow which may be an indicator that the sand screen 14 is failing, for example.

In addition, an absolute pressure transducer (not shown) is mounted at the domed end 66 for measuring a pressure of the oncoming production flow Y at the domed end 66 (i.e. the static head).

Disposed circumferentially around the elongate body portion 62 is a first sample surface 74 formed as a ring. The first sample surface 74 is an external surface of the body portion 62 and, as such, is exposed to the production flow Y in use. The apparatus 60 also comprises a first reference surface (not shown) which is similar to the first sample surface 74 in material construction, but the first reference surface is protected from exposure to the production flow Y in use.

The first sample surface 74 and the first reference surface together form part of an erosion sensor for detecting erosion due to particles and fluid in the production flow Y within the production tubing 12 in the region of the body portion 62. The erosion sensor is arranged to detect changes in electrical resistance of the first sample surface 74 and also to detect changes in the electrical resistance of the first reference surface.

The erosion sensor of the apparatus 60 within the production tubing 12 functions in a similar way to the erosion sensor of the apparatus 20 disposed around the sand screen 14. Thus the erosion sensor of the apparatus 60 provides a signal which varies in dependence upon a ratio of the electrical resistance of the first sample surface 74 to the electrical resistance of the first reference surface.

A second sample surface 76 formed as a ring is disposed circumferentially around the elongate body portion 62. The second sample surface 76 is an external surface of the body portion 62 and, as such, is exposed to the production flow Y in use. Similarly to the first sample surface 74 described above, the second sample surface 76 has an associated second reference surface which is similar to the second sample surface 76 in material construction, but the second reference surface is protected from exposure to the production flow Y in use. The second sample and reference surfaces function in a similar manner to the first sample and reference surfaces. However, the second sample surface 76 and the second reference surface are used to monitor corrosion rather than erosion. This is accomplished by manufacturing the second sample and reference surfaces from a material which is corrodible and may therefore be used to monitor the effects of corrosion. In contrast, the first sample and reference surfaces are manufactured from a corrosion-resistant material. The body portion 62 of the apparatus 60 further comprises a temperature sensor (not shown) for measuring a temperature of the production flow Y within the production tubing 12. As for the temperature sensor of the apparatus 20 described above, the temperature sensor of the apparatus 60 may be formed from a temperature-independent calibrated resistor connected in series with the erosion sensor reference surface.

As shown in FIG. 4, the sample surface 74 of the erosion sensor is located nearer the planar end 68 of the body portion 62, whereas the sample surface 76 of the corrosion sensor is located nearer the domed end 66. As discussed above, the flow accelerates as it moves along the production tubing 12 from the domed end 66 of the body portion 62 towards the planar end 68 of the body portion 62 because of the increasing cross-sectional area of the body portion 62. The acceleration of the flow means that the erosion effects of the flow are increased towards the planar end 68 of the body portion. Therefore, in order to provide greater sensitivity to erosion, the sample surface 74 of the erosion sensor is located nearer the planar end 68. In contrast, it is desired to keep erosion effects to a minimum on the sample surface 76 of the corrosion sensor. Therefore, the corrosion sensor is located nearer the domed end 66 of the body portion 62 as shown, where the shear stress is reduced and there are fewer particle impacts.

Furthermore, the geometry (e.g. length, taper angle) of the body portion and the position of the erosion sample surface 74 on the body portion 62 can be selected so that the velocity profile matches that at the sand screen interface. In this way, the speed of the radial production flow past the apparatus 20 will be similar to the speed of the longitudinal production flow past the erosion sample surface 74 of the apparatus 60 such that a fairly clean comparison of the two erosion measurements can be made. In addition, the metallurgy of the erosion sample surface 74 is preferably selected to match, the material of the tubular sample layer 22 of the apparatus 20 (which preferably matches the material of the sand screen 14). Again, this provides for a clean comparison between the various measurements and gives a true indication of potential sand screen erosion.

In an alternative embodiment (not shown), the body portion 62 includes a non-tapered cylindrical section disposed between the domed end 66 and the conical section of the body portion 62 as shown in FIG. 4. In this case, the corrosion sample surface 76 is preferably disposed as a ring around the non-tapered cylindrical section such that there is a reduced angle of incidence of the production flow on the corrosion sample surface 76 which reduces shear stress and particle impacts even further.

The body portion 62 of the apparatus 60 also comprises an acoustic sensor (not shown). The acoustic sensor is acoustically coupled to an associated sensor surface that is exposed to the production flow in use. The acoustic sensor and associated sensor surface are, however, acoustically decoupled from the production tubing 12. The acoustic sensor is therefore arranged to provide a signal which varies in dependence upon acoustic noise generated by impacts of particles and fluid in the production flow Y within the production tubing 12 on the acoustic sensor surface. The acoustic sensor surface could, for example, be formed from part of the external surface of the body portion 62.

As discussed above, the sensors of the apparatus 60 (i.e. the pressure transducers, the erosion sensor, the corrosion sensor, the temperature sensor, and the acoustic sensor) are all contained within the body portion 62 itself. Thus, all of these sensors are located within the production tubing 12 in the centre of the longitudinal production flow Y. This is made possible because power and communications are provided to the sensors by means of wires housed within one or more of the mounting fins 64.

When all of the pressure, temperature, electrical resistance (erosion and corrosion) and acoustic measurements derived from the apparatus 60 are used in combination, the apparatus 60 becomes a very valuable monitoring tool. For example, the flow rates derived from the differential pressure measurements can be, used to correct the amplitude in erosion (electrical resistance) and acoustic measurements for the purposes of sand quantification. In addition, the measured corrosion can be taken into account when considering the measured erosion (which may additionally include erosion/corrosion and corrosion effects after an outer anti-corrodible layer of the sample surface 74 has been abraded).

In embodiments where the acoustic sensor surface is the same as the electrical resistance sample surface for either or both of the apparatuses 20 and 60 described above, acoustic and electrical resistance measurements may be combined to provide useful information about the nature of, particles in the production flow, such as abrasive sand, or non-abrasive solids such as hydrates, or fines under normal operating conditions. Other useful information which may be derived includes the possible determination of increasing particle size which can provide early indications of sand screen failure. Similar concepts are described in UK Patent Application Publication No. GB 2431993, also in the name of Cormon Limited.

Multiples apparatuses 60 may be mounted within the same well 10. This can be particularly useful for a multiple-zone well 10 (i.e. a well that passes through a plurality of producing zones, as described above). In this case, an apparatus 60 may be mounted within the production tubing 12 at the top of each producing zone so as to identify which of the zones is developing sand. Then, if the measured sand/erosion from one zone is particularly high, it would be possible to control and limit the flow from that zone so as to potentially limit the quantity of sand produced and the resulting overall erosion.

Although the apparatus 60 shown in FIG. 4 has been described above with reference to monitoring a substantially longitudinal production flow within downhole production tubing, it should be noted that the apparatus 60 is also suitable for monitoring a substantially longitudinal flow in a sub-sea flowline or wellhead. In other words, non-downhole monitoring applications are also envisaged. In this case, the wires from the apparatus 60 could extend through a fin 64 and out through the associated tubing directly to an instrument.

The previously described apparatuses 20 and 60 may be used individually to measure pressure, temperature, erosion and flow outside the sand screen 14, or within the production tubing 12, respectively, as previously mentioned. However, when used in combination, the apparatuses 20 and 60 provide additional very useful information regarding the production flow. For the avoidance of doubt, it should be noted that the acoustic sensors of each apparatus 20 and 60 are acoustically decoupled from one another, and the sample layer 22 is electrically insulated from both the first and second sample surfaces 74 and 76.

By combining erosion measurements from the apparatus 20 around the sand screen 14 and the apparatus 60 within the production tubing 12, it is possible, for example, to detect destabilisation/fluidisation of the gravel pack 18.

As described above, fluidisation of the gravel pack describes the state in which the gravel in the gravel pack 18 is no longer sufficiently closely packed together so as to prevent movement of the gravel pack 18. In this case, the gravel in the gravel pack 18 starts to move around (i.e. act like a fluid) and is likely to cause significant erosion damage at the interface between the sand screen 14 and the gravel pack 18.

When an apparatus 20 is being used, the interfacial erosion described above will be detected on the sample layer 22 of the erosion sensor. Therefore, the erosion sensor of the apparatus 20 around the sand screen 14 detects not only erosion resulting from particles, such as fines, within the production flow X, but also erosion resulting from destabilisation/fluidisation of the gravel pack 18. In contrast, the erosion sensor of the apparatus 60 within the production tubing 12 detects erosion resulting from particles within the production flow Y, but is unaffected by destabilisation/fluidisation of the gravel pack 18 (assuming that the sand screen 14 remains intact).

Therefore, a comparison of the measured erosion upstream of the sand screen 14 at the apparatus 20 and downstream of the sand screen 14 at the apparatus 60 enables differentiation of underlying erosion producing mechanisms and thereby an early warning of the condition of the gravel pack 18 and the well 10 and sand production, etc. If the gravel pack 18 is performing as required, the erosion potential at the sample layer 22 of the apparatus 20 should be near equivalent to the erosion potential downstream of the sand screen 14 at the first sample surface 74 of the apparatus 60. Also, if the sand screen 14 becomes "plugged", the flow rate would be reduced downstream of the sand screen 14 at the apparatus 60 while erosion potential upstream of the sand screen 14 at the sample layer 22 may still exist.

Combinations of the temperature measurements from the apparatuses 20 and 60 are also very informative. The temperature sensor of the apparatus 20 measures the temperature of the production flow X through the gravel pack 18. The temperature sensor of the apparatus 60 measures the temperature of the production flow Y through the production tubing 12. If these measured temperatures are compared, they would be expected to be fairly similar and fairly constant under normal operating conditions of the well 10. However, a localised high speed gas flow is associated with a temperature drop. In contrast, a localised high speed oil flow is associated with a temperature rise. Therefore, monitoring of the measured temperatures can provide an indication of increased flow rates which could be due to failure of the sand screen 14, for example. Furthermore, since the temperature measurements using the apparatus 20 may be taken at each pair of electrical connection points at, say, 300 mm intervals, a longitudinal temperature profile is provided. This enables a comparison of the temperature measurements so as to indicate which longitudinal section of the sand screen 14 is developing problems or likely to fail. However, it should be noted that, due to natural downhole temperature gradients, the temperature of the production flow will tend to decrease as it rises.

Combinations of the pressure measurements from the apparatuses 20 and 60 can also be very useful. The absolute pressure transducer which forms part of pressure sensor 48 in the apparatus 20 measures the pressure $p_1$ of the production flow X through the gravel pack 18. The absolute pressure transducer mounted at the domed end 66 of the apparatus 60 can be used to measure the pressure $p_2$ of the production flow Y through the production tubing 12.

In normal operating conditions of the well 10, it would be expected that $p_1 > p_2$ such that there is a measurable pressure difference $\Delta p = p_1 - p_2$ across the sand screen 14. The pressure difference $\Delta p$ provides an indication of the flow rate of the production flow X through the sand screen 14. If the sand screen 14 starts to fail, due significant wear by erosion, the effectiveness of the sand screen 14 as a barrier is reduced such that the flow rate increases and the pressure difference $\Delta p$ decreases, potentially to zero. Alternatively, if the sand screen 14 becomes plugged, it becomes even more of a barrier to the production flow X such that the flow rate decreases and the pressure difference $\Delta p$ increases. This increase in $\Delta p$ would be accompanied by both an increase in the pressure $p_1$ of the production flow X through the gravel pack 18, and a decrease in flow rate in the production tubing 12 as measured by the pressure drop across the apparatus 60 between the first and second pressure transducers 70 and 72.

Thus, when used in combination, the apparatuses 20 and 60 as described herein provide a very large amount of information about the production flows X and Y in the well 10 which enables the provision of early warnings regarding sand production and/or plugging and/or potential failures of the equipment, such as the sand screen 14, and/or destabilisation/fluidisation of the gravel pack. These early warnings should enable a well operator to act so as to reduce the impact of such problems.

Although preferred embodiments of the invention have been described, it is to be understood that these are by way of example only and that various modifications may be contemplated.

The invention claimed is:

1. An apparatus for monitoring a production flow from a gravel pack into a tubular sand screen disposed concentrically around downhole production tubing in an oil or gas well, the apparatus comprising:

a tubular sample layer arranged to be disposed concentrically around the sand screen so as to be exposed to the radial production flow in use, the sample layer being electrically insulated from the production tubing in use, the sample layer having a plurality of spaced apart perforations radially extending therethrough so that the radial production flow can pass through the perforations; and an erosion sensor arranged to provide a signal which varies in dependence upon an electrical resistance of the sample layer, the electrical resistance of the sample layer being related to the erosion of the sample layer.

2. The apparatus of claim 1 further comprising a tubular reference layer disposed concentrically within the sample layer, the reference layer being protected from exposure to the production flow in use, and the erosion sensor signal varying in dependence upon a ratio of the electrical resistance of the sample layer to an electrical resistance of the reference layer, the reference layer having a plurality of spaced apart perforations radially extending therethrough.

3. The apparatus of claim 2 further comprising a first tubular electrically insulating layer disposed concentrically between the sample layer and the reference layer, and a second tubular electrically insulating layer disposed concentrically within the reference layer, the first and second tubular electrically insulating layer each having a plurality of spaced apart perforations radially extending therethrough.

4. The apparatus of claim 2 wherein the sample layer and the reference layer are connected in series via an electrical connector at a first end of the apparatus.

5. The apparatus of claim 2 wherein the sample layer and the reference layer each comprise at least one pair of electrical connection points.

6. The apparatus of claim 5 wherein the apparatus is arranged to drive a current through the sample and reference layers, and is further arranged to pick off voltage values from the pairs of electrical connection points so as to calculate electrical resistances of corresponding portions of the sample and reference layers.

7. The apparatus of claim 2 further comprising a temperature sensor arranged, in use, to measure the temperature of the production flow in the gravel pack, and wherein the electrical resistance of the reference layer varies in dependence upon temperature, the temperature sensor being arranged to compare a voltage across the reference layer with a voltage across a temperature-independent calibrated resistor of the apparatus.

8. The apparatus of claim 1 further comprising an acoustic sensor that is acoustically coupled to the sample layer such that the acoustic sensor is arranged to provide a signal which varies in dependence upon acoustic noise generated by impacts of particles and fluid in the gravel pack on the sample layer in use.

9. An apparatus for monitoring a substantially longitudinal production flow through downhole production tubing in an oil or gas well, the production tubing having a central longitudinal axis extending along the length thereof, the apparatus comprising:

a body portion; and mounting portions connected to the body portion and adapted to mount the body portion within the production tubing so that the body portion intersects with the central longitudinal axis of the production tubing;

wherein the body portion comprises an erosion sensor having an erosion sensor sample surface arranged to be exposed to the production flow in use, the erosion sensor being arranged to provide an erosion sensor signal which varies in dependence upon an electrical resistance of the erosion sensor sample surface;

wherein the body portion comprises a sample acoustic sensor arranged to be exposed to the production flow in use, the sample acoustic sensor being acoustically decoupled from the production tubing in use and being arranged to provide a sample acoustic sensor signal which varies in dependence upon acoustic noise generated by impacts of particles and fluid in the production flow on the sample acoustic sensor; and wherein the body portion comprises a substantially conical section having a cross-sectional area which increases in the direction of the production flow in use.

10. The apparatus of claim 9 wherein the mounting portions are adapted to mount the body portion substantially centrally within the production tubing, the mounting portions comprising a plurality of spaced apart fins radially outwardly projecting from an exterior surface of the body.

11. The apparatus of claim 9 wherein the erosion sensor sample surface is made from a material that is not susceptible to corrosion by the production flow.

12. The apparatus of claim 9 wherein the erosion sensor further comprises an erosion sensor reference surface made from the same material as the erosion sensor sample surface, the erosion sensor reference surface being arranged to be protected from exposure to the production flow in use, the erosion sensor signal varying in dependence upon a ratio of the electrical resistance of the erosion sensor sample surface to an electrical resistance of the erosion sensor reference surface.

13. The apparatus of claim 9 wherein the body portion further comprises a reference acoustic sensor that is acoustically decoupled from the sample acoustic sensor and the production tubing in use, the reference acoustic sensor being arranged to provide a signal which varies in dependence upon acoustic noise detected by the reference acoustic sensor.

14. The apparatus of claim 9 wherein the mounting portions are mutually spaced from one another around the body portion and each extend substantially radially outwards from the body portion.

15. A method of monitoring the production flow in a plurality of producing zones in an oil or gas well, the method comprising:

providing an apparatus according to claim 9 for each respective producing zone;

mounting each said apparatus in the production tubing in the vicinity of a respective producing zone using the mounting portions; and monitoring the production flow in each producing zone using a respective said apparatus.

16. A method of monitoring the condition of a gravel pack disposed within an oil or gas well, the well comprising production tubing, a sand screen disposed concentrically around the production tubing, and an outer casing, the gravel pack being disposed annularly between the sand screen and the outer casing, the method comprising:

disposing a tubular sample layer concentrically between the sand screen and the gravel pack;

measuring erosion of the tubular sample layer, the tubular sample layer being erodable by the production flow and by the gravel pack;

disposing a sample surface within the production tubing;

measuring erosion of the sample surface, the sample surface being erodable by the production flow;

comparing the measured erosion of the tubular sample layer and the measured erosion of the sample surface so as to deduce an extent of erosion of the tubular sample layer by the gravel pack; and thereby deducing a condition of the gravel pack.

17. The method of claim 16, wherein the tubular sample layer comprises a plurality of spaced apart perforations radially extending therethrough so that radial production flow can pass through the perforations.

18. An apparatus for monitoring the condition of a gravel pack disposed within an oil or gas production well, the well comprising production tubing, a sand screen disposed concentrically around the production tubing, and an outer casing, the gravel pack being disposed annularly between the sand screen and the outer casing, the apparatus comprising:

a tubular sample layer arranged to be disposed concentrically between the sand screen and the gravel pack, the tubular sample layer having a plurality of spaced apart perforations radially extending therethrough so that radial production flow can pass through the perforations;

a first erosion sensor for measuring erosion of the tubular sample layer, the tubular sample layer being erodable by the production flow and by the gravel pack in use;

a sample surface arranged to be disposed within the production tubing;

a second erosion sensor for measuring erosion of the sample surface, the sample surface being erodable by the production flow in use; and a processor for comparing the measured erosion of the tubular sample layer and the measured erosion of the sample surface.

19. A system for monitoring a substantially longitudinal production flow through downhole production tubing in an oil or gas well, the system comprising:

a section of downhole production tubing for use in an oil or gas well, the section of downhole production tubing having an interior surface that bounds a passage that extends along the length of the tubing, the passage having a central longitudinal axis; and a monitoring apparatus comprising:

a body portion having an exterior surface; and mounting portions connecting the body portion to the interior surface of the section of downhole production tubing so that the body portion intersects with the central longitudinal axis of the tubing and production flow passing through the passage of the tubing is forced to flow over the exterior surface of the body;

wherein the body portion comprises an erosion sensor having an erosion sensor sample surface arranged to be exposed to the production flow in use, the erosion sensor being arranged to provide an erosion sensor signal which varies in dependence upon an electrical resistance of the erosion sensor sample surface;

wherein the body portion comprises a sample acoustic sensor arranged to be exposed to the production flow in use, the sample acoustic sensor being acoustically decoupled from the production tubing in use and being arranged to provide a sample acoustic sensor signal which varies in dependence upon acoustic noise generated by impacts of particles and fluid in the production flow on the sample acoustic sensor; and wherein the body portion comprises a substantially conical section having a cross-sectional area which increases in the direction of the production flow in use.

20. The system of claim 19 wherein the mounting portions comprise a plurality of spaced apart fins radially outwardly projecting from the exterior surface of the body and connecting to the interior surface of the section of downhole production tubing so that the exterior surface of the body is spaced apart from the interior surface of the section of downhole production tubing.

21. A system for monitoring the condition of a gravel pack disposed within an oil or gas production well, the system comprising:

production tubing;

a sand screen disposed concentrically around the production tubing;

an outer casing;

a gravel pack disposed annularly between the sand screen and the outer casing; and a measuring apparatus comprising:

a tubular sample layer disposed concentrically between the sand screen and the gravel pack;

a first erosion sensor for measuring erosion of the tubular sample layer, the tubular sample layer being erodable by the production flow and by the gravel pack in use;

a sample surface arranged to be disposed within the production tubing;

a second erosion sensor for measuring erosion of the sample surface, the sample surface being erodable by the production flow in use; and a processor for comparing the measured erosion of the tubular sample layer and the measured erosion of the sample surface.

* * * * *